United States Patent [19]

Coone et al.

[11] 4,050,731

[45] Sept. 27, 1977

[54] SHIFTING APPARATUS

[75] Inventors: Malcolm G. Coone; Billy C. Malone; Marvin Lee Holbert, Jr., all of Houston, Tex.

[73] Assignee: Lynes, Inc., Houston, Tex.

[21] Appl. No.: 652,175

[22] Filed: Jan. 26, 1976

[51] Int. Cl.[2] ..... B66C 1/42

[52] U.S. Cl. ..... 294/86.24; 61/53.72; 61/94; 294/90; 294/93

[58] Field of Search ..... 294/63 A, 86.1, 86.14, 294/86.15, 86.24, 86.25, 90, 93–97, 99 R; 29/237; 61/53.5, 53.7, 53.72, 94; 138/93; 166/212; 285/97, 100, 104, 141; 403/5

[56] References Cited

U.S. PATENT DOCUMENTS

| | | | |
|---|---|---|---|
| 2,203,799 | 6/1940 | Shaffer | 294/93 X |
| 2,785,758 | 3/1957 | Baker | 166/212 |
| 2,826,445 | 3/1958 | Tidland | 294/93 |
| 3,006,152 | 10/1961 | Rusche | 61/53.72 |
| 3,264,834 | 8/1966 | Guild | 61/53.72 |

*Primary Examiner*—Johnny D. Cherry

*Attorney, Agent, or Firm*—William C. Norvell, Jr.

[57] ABSTRACT

Apparatus is provided having particular use in conjunction with setting of longitudinally extendable piling units for anchoring an offshore platform for subsequent use in drilling, production, completion and workover of a subterranean well. The apparatus is designed to be selectively movable within the base of the piling, thereafter the unit is manipulated to urge a plurality of circumferentially extending segmented units to expandably engage within the piling base and, preferably, be locked therewithin, such that the piling may be positionably engaged along longitudinally extending legs of the platform. In a preferred embodiment, the apparatus provides an inflatable element which expands the segments for engagement with the bore of the piling. Alternatively, a modified apparatus utilizes a unit which is inserted within the base of the piling by means of a wire line or related apparatus. In still another form of the invention, a similar apparatus is provided in modified form on elements which are activated by means of spring loaded dog elements. A method also is provided for utilization of the present apparatus.

8 Claims, 7 Drawing Figures

5A
5A

SHIFTING APPARATUS

BACKGROUND OF THE INVENTION

1. Field Of The Invention

The present invention relates to an apparatus and method for grasping an element for subsequent travel of said element, said element being carriable by a second element, such as a crane, or the like. In a preferred form, the apparatus is utilized within the bore of a longitudinally extending piling for use in a subterranean drilling platform.

2. Description Of The Prior Art

In the drilling of a subterranean offshore oil or gas well, it is, oftentimes necessary, to insert on the sea bed, a platform structure having a plurality of leg members extending above the water surface to the sea bed floor. At the top of the platform, the legs are connected by a series of "criss-cross" members, and at the immediate top of the legs, there is connected thereto a table-like member generally referred to simply as the "platform". From the platform, drilling operations are conducted, including the drilling of the well, the completion thereof, and workover operations. In some instances, the platform is utilized during production activities, such as setting and removing packers, gravel pack operations, testing programs, and the like.

Along the exterior of each of the legs of the platform structure are a series of longitudinally extending sleeve members which are welded or otherwise engaged to the platform legs, the sleeve members having bores therewithin for insertion therethrough of a piling member, which is subsequently and at least partially urged through the sea floor for securing the platform to the sea floor, or sea bed. Thereafter, the piling structure generally is cemented or "grouted" to the sleeve and, in turn, to the platform structure to assure proper engagement of the piling to the sleeve, and to assure the securing of the platform to the sea bed. Heretofore, the piling member has been inserted through the sleeve by means of a derrick or hoist apparatus, the holding line of which has been directly attached to the top of the piling by means of a welded cross-member or the like affixed thereto. Subsequent to the lowering operation, the wire line is retracted from the piling by mechanical means or, in some instances, it has been necessary to utilize a diver who will carry welding equipment which can be utilized in an aqueous environment to remove the cross member and the wire from the piling. These removal operations are extremely costly and time consuming.

With the present invention, it has been discovered that an apparatus can be provided whereby segmented units are urged outwardly and away from the apparatus to and within the base of the piling to grasp the piling interior. The apparatus is manipulated by a derrick or hoist line and can be readily and easily removed from the piling upon completion of the operation by activating the apparatus to cause the segmented elements to retract from the fixed position within the bore of the piling. Thereafter, the apparatus is removed from the piling to the top of the platform structure and may be reused for the setting of subsequently needed pilings.

The apparatus of the present invention may be used in conjunction with other elements which must be carried by a derrick, hoist or other apparatus, and is not necessarily limited for use in conjunction with pilings which are utilized with oil well drilling platforms. For example, the present invention could be utilized to carry tubing or pipe or other hollow members in the construction of buildings, pipelines, ships, and the like.

SUMMARY OF THE INVENTION

Apparatus is provided having particular use in conjunction with setting of longitudinally extendable piling units for anchoring an offshore platform for subsequent use in drilling, production, completion and workover of a subterranean well. The apparatus is designed to be selectively movable within the bore of the piling, thereafter the unit is manipulated to urge a plurality of circumferentially extending segmented units to expandably engage with the piling base, and preferably, be locked therewithin, such that the piling may be positionably engaged along longitudinally extending legs of the platform. In a preferred embodiment, the apparatus provides an inflatable element which expands the segments for engagement with the base of the piling. Alternatively, a modified apparatus utilizes a unit which is inserted within the bore of the piling by means of a wire line or related apparatus. In still another form of the invention, a similar apparatus is provided in modified form on elements which are activated by means of spring loaded dog elements. A method also is provided for utilization of the present apparatus.

DESCRIPTION OF THE PREFERRED EMBODIMENTS

In a preferred form, the present apparatus utilizes a series of circumferentially extending segmented elements which are moved into engagement and disengagement within the base of the holding member by means of an inflation system comprising means for conveying hydraulic or pneumatic fluid to a chamber which is defined by the interior of an inflatable rubber-like elastomeric member.

Figure 1:
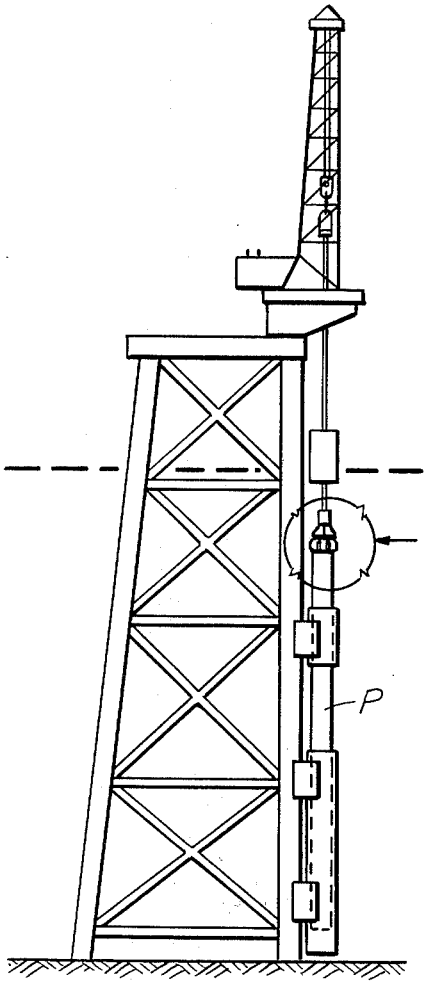
FIG. 1 is a schematic drawing of the use of the present invention in the lowering of a piling within a guide and subsequent insertion into its sleeve, with the derrick and platform being shown above the water line.
Figure 2:
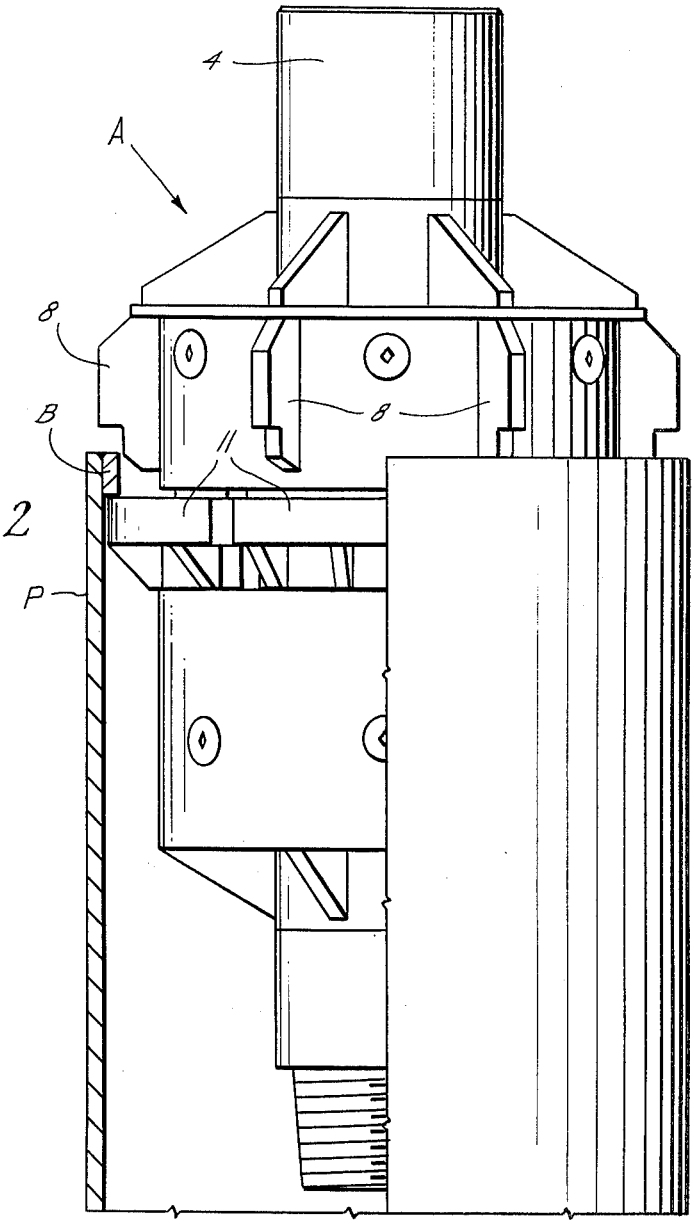
FIG. 2 is a longitudinally extending exterior view of the apparatus of the present invention within the bore of the member which is to be grasped and carried by the apparatus.
Figure 3A:
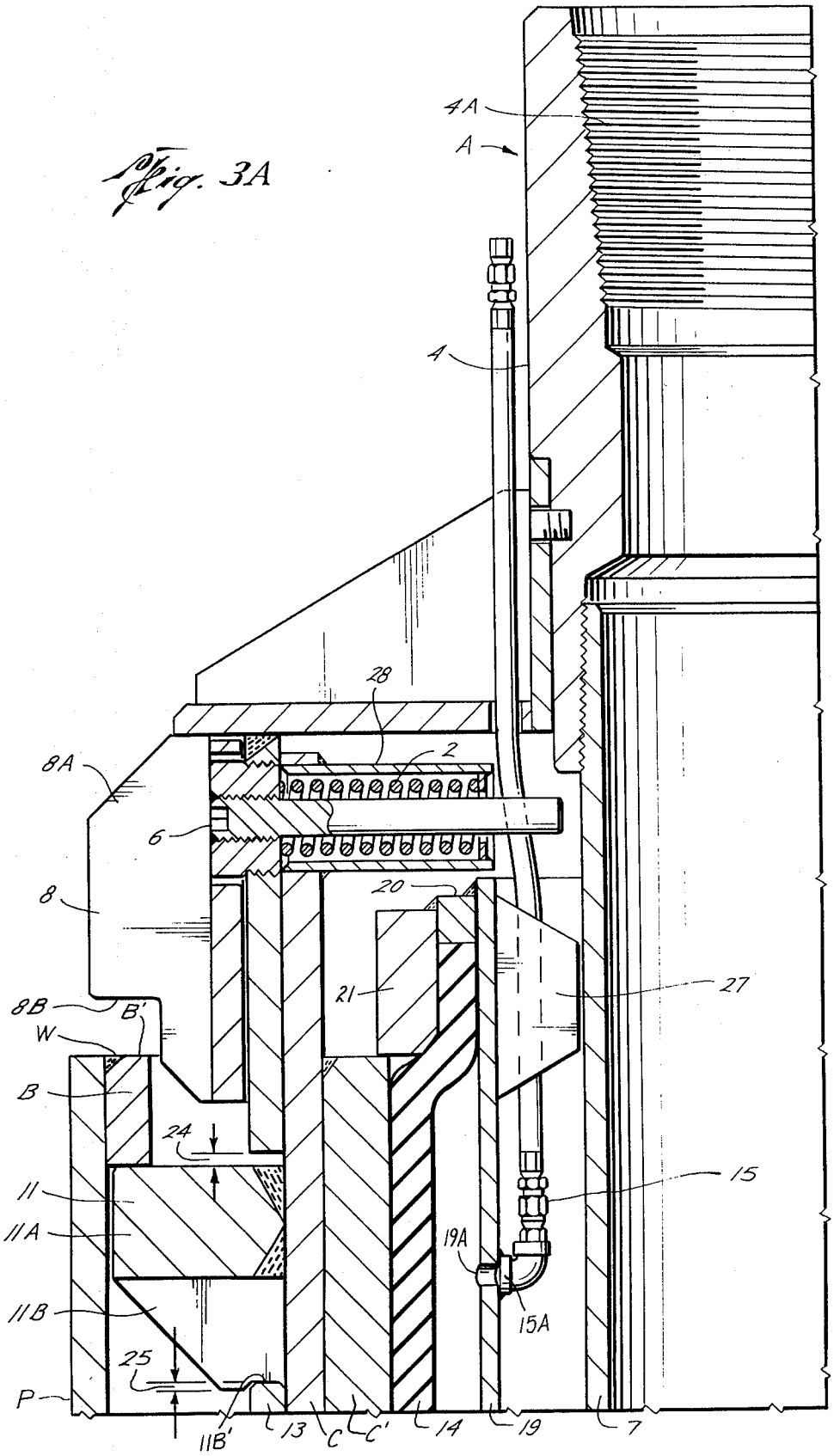
FIG. 3A is a longitudinally extending drawing in segment, showing a preferred form of the present apparatus in engaged position within the bore of a piling or other member, FIG. 3B being a lower continuation of the view shown in FIG. 3A.
Figure 3B:
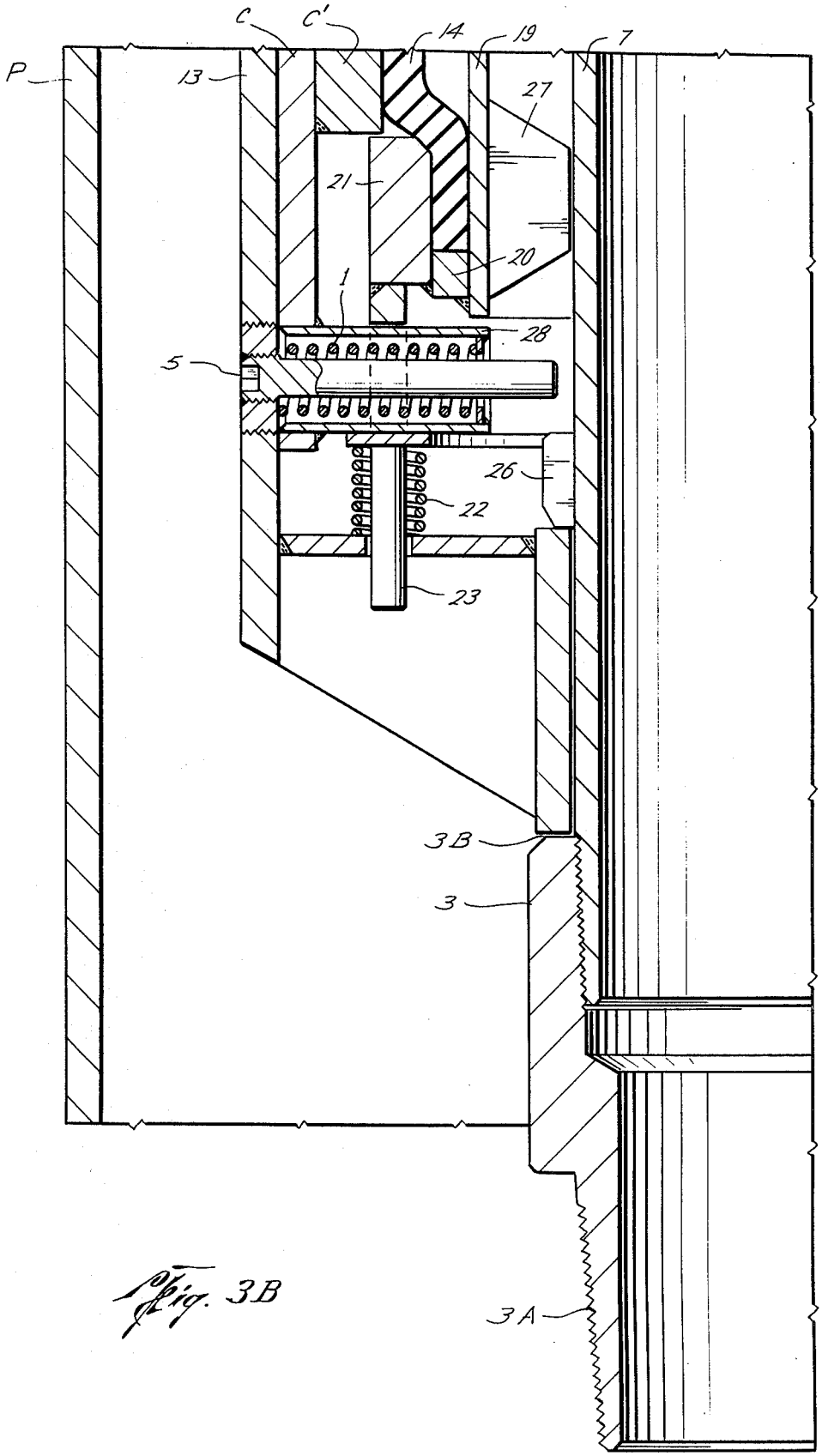

Referring now to FIG. 3A and 3B an externally inflatable packing element 14, of known construction to those skilled in the art and available commercially from Lynes, Inc., and shown in many variations of their 1975–76 CATALOG, is circumferentially and exteriorally affixed around inflation plate 19 having therein a grooveway 19A defining a bore for receipt of the lower end 15A of fluid line 15 which extends within and through the apparatus A to a control element (not shown), where the fluid line 15 is affixed to pressure activating means. Upper and lower holding rings 20 engage the upper and lower ends, respectively, of the packing element 14 to the inflation plate 19 for sealing securement thereto. Exteriorally of the packing element 14 and the holding ring 20 are upper and lower lock discs 21 which are affixed to the upper and lower ends of the packing element for additional securing thereof. The lower disc 21 also has engaged thereto a spring control mandrel 23 for purposes which will be hereinafter described. Affixed to the opposite wall and side of the inflation plate and away from the packing element 14 are upper and lower brace members 27 which are actually slidable on an inner housing member 7 which, in turn, is threadably connected at its upper end by and to a top sub memnber 4 and is threadedly connected at its lower end to a companion bottom sub member 3. The top sub 4 is provided with thread section 4A for suitable engagement to a string of pipe, the length of the pipe and the number of lengths not being critical to the present invention, and serving to extend the apparatus to a lifting device located upon the platform or attendant derrick barge (shown in FIG. 1).

The inflation mechanism as above described is immediately operationally related to a series of circumferentially extending and outwardly expandable, inwardly retractable support rings 11 formed by externally protruding upper and lower disc members 11A and 11B, repectively, which, in turn, are each affixed to a central ring member C, the central ring member C having an inner wall member $C^1$ which is engageable by the exterior of the packing element 14 upon inflation of the packing element 14. The central ring C has upper and lower spring carriages 28 which form an integrable part of the central ring C. The spring carriages 28 cause responsive activation of coil, compression spring elements 1 and 2, respectively, housed within the spring carriages.

The lower bit 21 has affixed at its lower end a longitudinally extending spring mandrel 23, having extended at the lower end thereof a coiled, compressed spring element 22. When the support ring segments 11 are engaged as hereinafter described, an upward pull on the tubing string affixed to the top sub 4 will cause shifting of the support ring elements 11 to compress the spring 22 by means of the force which is exerted on the lower lock disc 21 and its companion spring mandrel 23. As the lock disc 21 and the mandrel 23 are shifted lowerly, a small clearance area 24 is created above the disc member 11A of the support ring 11, and the lowermost end of the disc member 11B will slip into safety notch 25 which is defined by the upper end of the exterior housing 13 of the apparatus A, and an inwardly extending lower shoulder 11B$^1$ on the lower disc member 11B of the support ring 11. The engagement of the support ring 11 in the safety notch 25 prevents accidental retraction of the segments or rings 11 in the event that the inflatable element 14 is inadvertently deflated, by means of, for example, a break in the fluid line 15 between the apparatus A and the top of the platform. Thus accidental release from the piling P, or holding structure, is prevented so long as sufficient weight is maintained to compress spring 22.

At a preselected location along the smooth bore of the piling P is pre-fixed an inwardly protruding circumferentially extending lift ring B which may be either affixed to the piling P in and as one single unit, or as a series of units, complimenting the construction of the support rings 11. The lift ring B is affixed to the piling P by means of weld W or other convenient fixing mechanism.

OPERATION

At the platform surface, or other convenient location, the apparatus A is affixed to a string of tubing by connection to the top sub 4. The fluid line 15 is connected to a control line panel (not shown) generally operable from the top of the platform structure. The bottom sub 3 may be connected at its threaded end 3A to a second and lower string of tubing, if necessary or desirable. The bottom sub 3 has at its upper end an upwardly facing, outwardly protruding shoulder 3B which in companion operation with a series of circumferentially extending stop blocks 26 which are engaged exteriorally around the inner housing 7, serves to prevent axial movement of the housing member 13. Thus, upward loads are transmitted through the top sub 4, the inner housing 7, the bottom sub 3 and the exterior housing 13, and thereafter the load is transferred to the segments 11 by means of the safety notch 25. Thereafter, and concurrently, the load is transferred to the piling P through the lift ring B. The load is, of course, controlled by the force exerted upon the tubing string affixed to the upper sub 4.

It should be noted that the apparatus A may be supplied with an optional stop ring 8 which is affixed to the exterior of the apparatus A and serves to prevent the apparatus A from accidentally sliding within the interior of the piling P by means of an outwardly, protruding shoulder section 8A, the diameter of which is greater than that afforded through the piling by means of the lift ring B. In the event that the control string breaks or is dropped, the apparatus will be prevented from dropping through the bore of the piling P because the lower and outer edge 8B of the stop ring 8 will come to rest upon the upper and outwardly protruding end $B^1$ of the lift ring B.

When it is desired to release the apparatus A from the piling P, the inflation pressure of the fluid within the fluid line 15 is released, and the rubber-like elastomeric bladder inflation element 14 will contract inwardly. Thereafter, the tubing string connected to the top sub 4 is lowered a sufficient length to allow the segments 11 to disengage from the lift ring B while, at the same time, spring element 22 urges the support ring segments 11 upwardly reducing the clearance at the space 24 and disengaging the disc member 11B of the support 11 from the safety notch 25. Concurrently, horizontal spring elements 1 and 2 will cause the outwardly protruding support rings 11 to retract, reducing the outer diameter less then that of the internal diameter of the lift ring B such that the apparatus A may be conveniently withdrawn from the piling P without interference to longitudinal movement.

Figure 4:
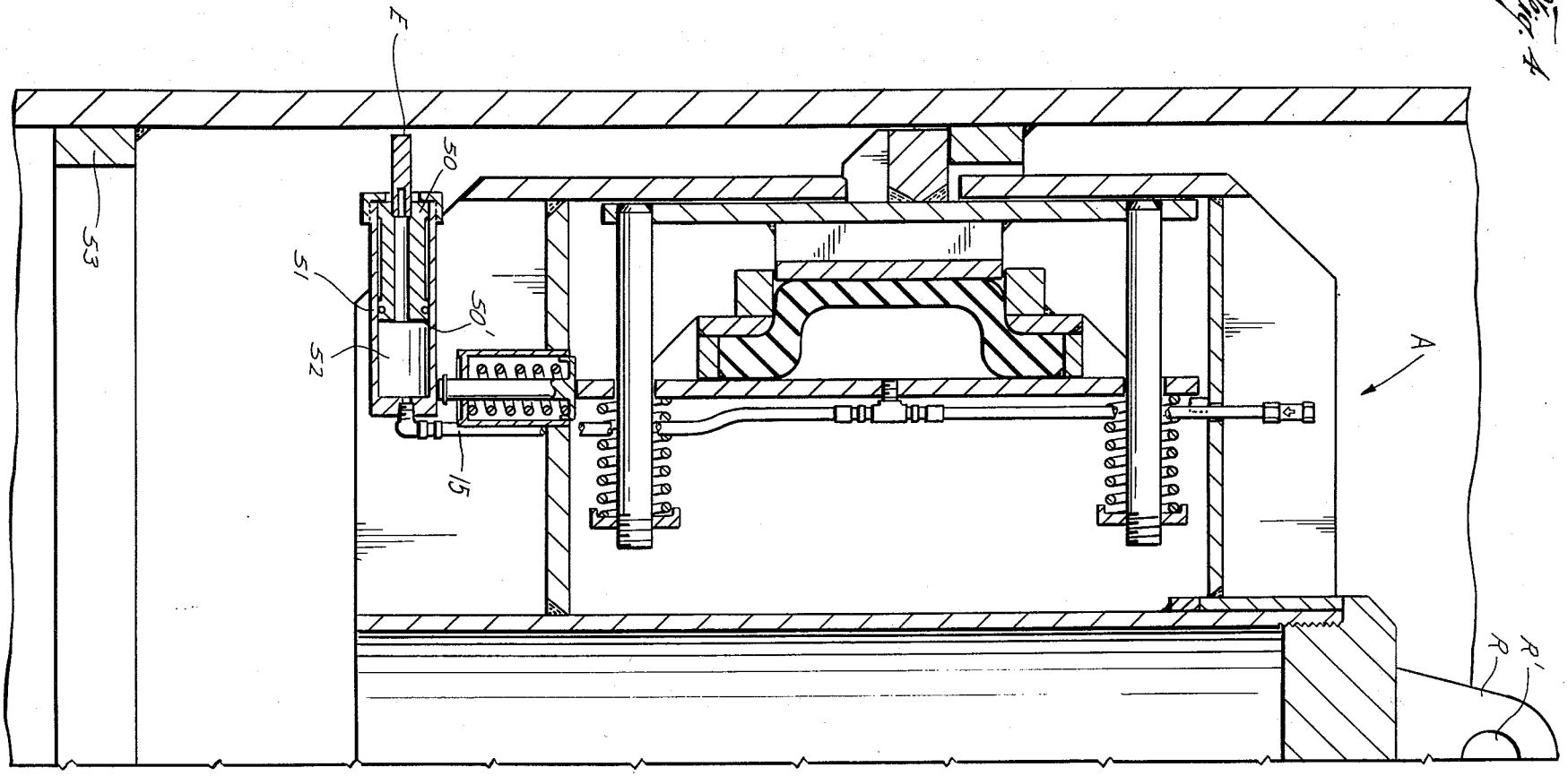
FIG. 4 is a longitudinally segmented, in part, view of the apparatus of the present invention in a modified form for insertion within a holding member by means of a wire line or related tool.
Figures 5, 5A:
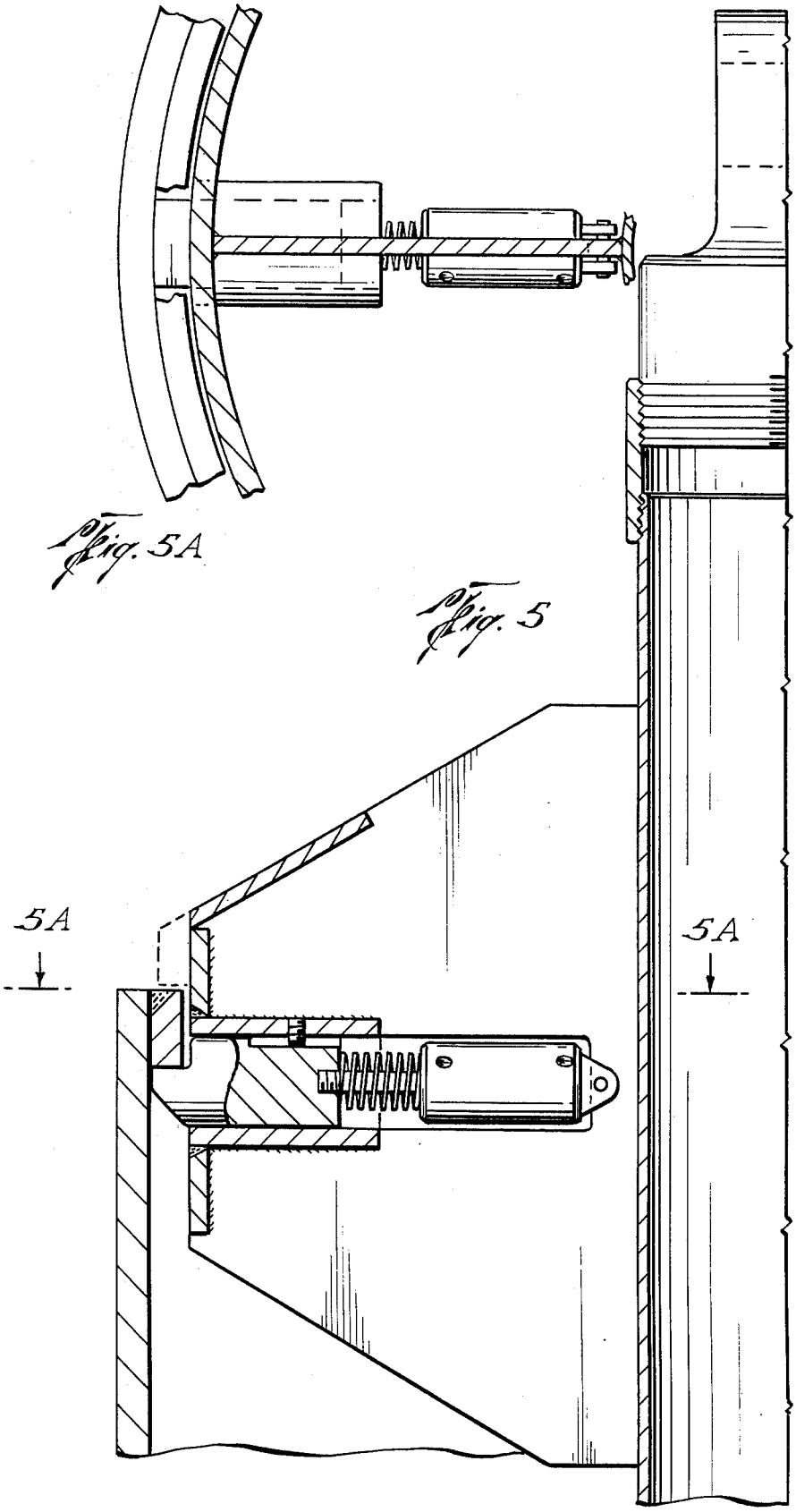
FIG. 5 is a partial longitudinal drawing depicting still another form of the invention utilizing spring loaded dog elements to activate a plurality of extendable members.
FIG. 5A is a sectional view taken along lines 5A—5A of FIG. 5.

As an alternate preferred apparatus, reference now is made to FIG. 4, which utilizes essentially the same apparatus as as disclosed in FIG. 3. A ring R is affixed to the top exterior of the apparatus A, the ring R having a central bore $R^1$ for engagement therethrough of a wire line or other means for connecting the apparatus A to a line which, in turn, is operatively maneuvered by a hoist upon the platform or related structure, the wire line not being shown, but serving the same office as the string of tubing which is affixed to the sub 4 as shown in FIG. 3A and 3B.

FIG. 4 shows the apparatus A having a shear off element E affixed to a pistion element 50 housed within its housing 51 and the end 50[1] of element 50 and housing 51 defining a fluid chamber 52 which is in communication with the fluid line 15. This apparatus is operated essentially as is shown in FIGS. 3A and 3B, but is removed from the bore of the piling P by lower travel of the apparatus A on the wire line such that the shear off element E engages a release shoulder 53 circumferentially extending and outwardly protruding within the bore of the piling P and conveniently welded or otherwise affixed thereto. The weight afforded on the shear off element E will cause the stem to shear and expose the chamber 52 to exterior pressure, which will be lower than the pressure within the fluid line. As the pressure within the fluid line 15 is reduced, the packing element 14 is retracted and the operation as above described is initiated, the apparatus A then being permitted to be retracted from the base of the piling P.

The apparatus of the present invention also may be utilized in a form whereby the inflatable section and the fluid lines are replaced by means of a plurality of spring loaded dogs which may be hydraulically released and, optionally, set.

Although the invention has been described in terms of specified embodiments which are set forth in detail, it should be understood that this is by way of illustration only and that the invention is not necessarily limited thereto, since alternative embodiments and operating technique will become apparent to those skilled in the art in view of the disclosure. Accordingly, modifications are contemplated which can be made without departing from the spirit of the described invention.

What is desired to be secured by Letters Patent is:

1. Apparatus for at least partial insertion within a longitudinally shiftable element, comprising: a longitudinally extending housing; an inflatable device within said housing; means communicable with said inflatable device for selective control of fluid pressure within and manipulation of said inflatable device; control elements within said housing selectively operational to expanded and retracted positions in response to said inflatable device; means on said housing for locking said control elements into expanded position, at least part of said elements when in the expanded position extending out of and away from said housing, said elements when in the expanded position engaging said shiftable element and governing longitudinal movement thereof, said elements when in the retracted position disengaging said shiftable element.

2. Apparatus of claim 1 additionally comprising spring loaded members operationally responsive to manipulation of said inflatable device to shiftably urge said control elements to retracted position.

3. The apparatus of claim 1 wherein said control elements have means thereon for engagement with companion means on said longitudinally shiftable element to transfer load on said shiftable element to said apparatus through said control elements.

4. Apparatus for at least partial insertion within a longitudinally shiftable element comprising: a longitudinally extending housing; hydraulically releasable means within said housing; means communicable with said hydraulically releasable means for manipulation of said hydraulically releasable means; control elements within said housing selectively operational to expanded and retracted positions in response to manipulation of said hydraulically releasable means; and means on said housing for locking said control elements into expanded position, at least part of said elements when in the expanded position engaging said shiftable element and governing longitudinal movement thereof, said elements when in the retracted position disengaging said shiftable element.

5. Apparatus for at least partial insertion within a longitudinally shiftable element comprising: a longitudinally extending housing; hydraulically releasable means within said housing; means communicable with said hydraulically releasable means for manipulation of said hydraulically releasable means; control elements within said housing selectively operational to expanded and retracted positions in response to manipulation of said hydraulically releasable means; means on said housing for locking said control elements into expanded position; and means within said housing for urging said control elements out of locking and expanded position, at least part of said elements when in the expanded position engaging said shiftable element and governing longitudinal movement thereof, said elements when in the retracted position disengaging said shiftable element.

6. Apparatus for at least partial insertion within a longitudinally shiftable element, comprising: a longitudinally extending housing; an inflatable device within said housing; means communicable with said inflatable device for selective control of fluid pressure within and manipulation of said inflatable device; control elements within said housing selectively operational to expanded and retracted positions in response to manipulation of said inflatable device, means on said housing for locking said control elements into expanded position; and means within said housing for urging said control elements out of locking and expanded position, at least part of said elements when in the expanded position extending out of and away from said housing, said elements when in the expanded position engaging said shiftable elements and governing longitudinal movement thereof, said elements when in the retracted position disengaging said shiftable element.

7. Apparatus for the setting of a longitudinally extendable piling unit for anchoring an offshore platform for subsequent use in drilling, production, completion and workover of a subterranean well, said apparatus comprising: a longitudinally extending housing; an inflatable device within said housing; means communicable with said inflatable device for selective control of fluid pressure within and manipulation of said inflatable device; control elements within said housing selectively operational to expanded and retracted positions in response to manipulation of said inflatable device; and means on said housing for locking said control elements into expanded position, at least part of said elements when in the expanded position extending out of and away from said housing, said elements when in the expanded position engaging said piling and governing the longitudinal movement thereof, said elements when in the retracted position disengaging said shiftable element from said piling.

8. Apparatus in conjunction with the setting of a longitudinally extendable piling unit for anchoring an offshore platform for subsequent use in drilling, production, completion and workover of a subterranean well, said apparatus comprising: a longitudinally extending housing; an inflatable device within said housing; means communicable with said inflatable device for selective control of fluid pressure within and manipulation of said inflatable device; control elements within said housing selectively operational to expanded and retracted positions in response to manipulation of said inflatable device; means on said housing for locking said control elements into expanded position; and means within said housing for urging said control elements out of locking and expanded position, at least part of said elements when in the expanded position extending out of and away from said housing, said elements when in the expanded position engaging said piling unit and governing longitudinal movement thereof, said elements when in the retracted position disengaging said piling unit.

* * * * *